US006801726B2

(12) United States Patent
Shimizu et al.

(10) Patent No.: US 6,801,726 B2
(45) Date of Patent: Oct. 5, 2004

(54) IMAGE FORMING APPARATUS

(75) Inventors: Akihiro Shimizu, Chiba (JP); Koki Watanabe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/199,106

(22) Filed: Jul. 22, 2002

(65) Prior Publication Data

US 2003/0021610 A1 Jan. 30, 2003

(30) Foreign Application Priority Data

Jul. 27, 2001 (JP) ..... 2001-228503

(51) Int. Cl.[7] ..... G03G 15/00
(52) U.S. Cl. ..... 399/44; 399/398; 399/400
(58) Field of Search ..... 399/44, 92, 100, 399/297, 310, 315, 397, 398, 400

(56) References Cited

U.S. PATENT DOCUMENTS 5,240,242 A 8/1993 Ando et al. ..... 271/118
6,282,402 B1 8/2001 Hayashida ..... 399/398

FOREIGN PATENT DOCUMENTS

JP 3-138675 6/1991
JP 6-67490 3/1994

*Primary Examiner*—Hoang Ngo
(74) *Attorney, Agent, or Firm*—Fitzpatrick, Cella, Harper & Scinto

(57) ABSTRACT

In an image forming apparatus provided with a stripping device for stripping a sheet from a photosensitive member, a fan for sucking the sheet, and a duct for connecting the stripping device and the fan together, the fan is started when an operation signal detector for detecting an electrical signal by a predetermined operation in preparation for the start of a copy job detects the electrical signal.

8 Claims, 7 Drawing Sheets

IMAGE FORMING APPARATUS

BACKGROUND OF THE INVENTION

1. Field of the Invention

The invention relates to an image forming apparatus, which can optimize the rising sequence of a fan and shorten the time from the start of a copy job to the delivery of the first sheet out of the apparatus.

2. Description of Related Art

An example of the image forming apparatus according to the prior art will hereinafter be described with reference to FIGS. 6 and 7 of the accompanying drawings.

FIG. 6 is a typical cross-sectional view of a photosensitive member, a transferring device, a stripping device, a transport device and a fixing device in an image forming portion contained in the image forming apparatus (not shown).

FIG. 7 simply shows the relation between the time from the standby state through the copying operation to the stop of the copying operation of the image forming apparatus and the operation sequence of a fan.

As shown in FIG. 6, a sheet P transported to registration rollers 501 as sheet supplying means by feeding and transporting means (not shown) comes into between a photosensitive drum 502 which is a photosensitive member bearing thereon a toner image formed by electrophotography and being rotated and transferring means 503 and stripping means 504 disposed in proximity to and opposed relationship with the photosensitive drum 502.

In a transferring area, the sheet P begins to contact with the photosensitive drum 502 which is an image bearing member, passes through the transferring area and arrives at the corona discharge area of the stripping means 504, whereupon the sheet P which has so far been in contact with the photosensitive drum 502 is stripped from the photosensitive drum 502.

The sheet P thus stripped is completely stripped from the photosensitive drum 502 by suction means 505 playing the auxiliary role of the stripping means 504, and is sent to transporting means 506 along a guide 507 provided on the sheet passing surface of the stripping means 504. The suction means 505 is comprised of a duct 508 and a stripping fan 509.

Further, the transporting means 506 is comprised of a driving runner 510, a driven runner 511 and a transport belt 513 looped around and driven by the driving runner 510 and the driven runner 511. The transported sheet P is transported to fixing means 514 by the transport belt 513.

Here, the stripping fan 509 assumes the starting sequence as shown in FIG. 7. In a graph as shown in FIG. 7, a section up to time T1 of a line designated by "a" represents the standby state of the image forming apparatus. In the standby state, a user performs a series of operations in preparation for the copying operation, and when he depresses a copy start button at T1, the stripping fan 509 is started. The stripping fan 509 rises to a use, rotating speed at T1–T3. T2 and T2' indicate the time when the leading edge of the sheet P arrives at the registration rollers 501.

If the leading edge of the sheet P has already arrived at the registration rollers 501 at T2 (T2<T3), the sheet P stands by at the position of the registration rollers 501 until T3 when the stripping fan 509 rises. Or if the leading edge of the sheet P has arrived at the registration rollers 501 at T2' (T2'>T3) whereat the stripping fan 509 is already in its rising state, the sheet P does not stand by at the registration rollers 501 but shift is made to the image forming operation.

Thereafter, the image forming operation is started and at T4, the last sheet P is delivered out of the image forming apparatus, whereupon the stripping fan 509 performs the stopping operation.

Also, if as previously described, in the line designated by "a" in the graph, the leading edge of the sheet P arrives at the registration rollers 501 at T2, as a measure for shortening the time for which the sheet P stands by at the position of the registration rollers 501, use has been made of a sequence as shown by a line designated by "b" in the graph for pre-starting the stripping fan 509 in the standby state.

In recent years, as seen in an image forming apparatus such as a copying machine or a printer for forming an image which is provided with a post-processing apparatus having the functions of sorting, stapling, punching and binding sheets on which images have been formed, the complication of the apparatus system has been advanced while on the other hand, the higher speed of the apparatus has also been advanced to improve productivity. Further, with the advance of the higher speed of the apparatus on the one hand, the trend for energy saving has become popular as the consideration for environmental problems. So, the above-described prior art has suffered from such problems as will be shown below.

In the prior-art image forming apparatuses of low and medium speeds, a method of corona-discharging to a sheet has been popular as a method of stripping a sheet from a photosensitive member. In recent years, however, the higher speed of the image forming apparatuses have been advanced to improve productivity and it has become difficult to strip a sheet from the photosensitive member by the aforedescribed stripping method alone. For example, as the image forming apparatus becomes higher in speed, the rotating speed of the photosensitive member increases and therefore, sufficient discharge is not done to the sheet and bad stripping may result and jam may sometimes be caused.

So, a solution to these problems has been attempted by a countermeasure such as strengthening the discharge current or sucking the sheet by a fan through a duct in the stripping portion. Also, in order that the sheet stripped from the photosensitive member may be standby transported to the fixing means even if the higher speed is advanced, use has often been made of a fan in the transporting means to suck the sheet by the fan through a duct to thereby suck the sheet onto the transporting means as well as to satisfy stable transportability.

However, when the higher speed is further advanced, suction means greater in suction force becomes necessary in order to improve the aforementioned separability and transportability. Consequently, the fan necessarily becomes bulky and this has led to such a problem as will be described below.

A bulky fan, as compared with the fan heretofore used, becomes long in its rising time and therefore, if for example, the fan is started from a point of time at which the user has operated a copy button to thereby start a copy job, a certain extent of time is required until the rotation of the fan becomes stable and thus, even a sheet started to be transported stops at a predetermined position for the time until the rotation of the fan becomes stable. This leads to the problem that the time until the first sheet after the start of the copy job is delivered out of the apparatus becomes long, and this is against the aforedescribed improvement in the productivity of the image forming apparatus.

Therefore, in the prior art, the shortening of the rising time has been contrived by operating the fan at a half of the ordinary use rotating speed or keeping the fan at the ordinary use rotating speed in the standby state of the image forming apparatus. However, depending on the installation environment (temperature and humidity) of the image forming apparatus or the type of paper great in rigidity such as thick paper good in separability, there is a case where the rotating speed of the fan is excessive. In such case, the fan is operated even during a time when the suction of a sheet is not required and thus, consumes extra electric power, and this is against the above-described trend for energy saving.

SUMMARY OF THE INVENTION

The present invention has been made in order to solve the above-noted problems peculiar to the prior art and the object thereof is to provide an image forming apparatus in which the rising sequence of a fan made bulkier with the higher speed of the image forming apparatus is reconsidered and the time from the start of a copy job until the first sheet is delivered out of the apparatus is shortened to thereby make high productivity possible and as the consideration for environmental problems, the consumption of extra electric power in the standby state of the image forming apparatus is suppressed.

In order to achieve the above object, an image forming apparatus according to the present invention comprises:

sheet supplying means for supplying a sheet to a photosensitive member;

transferring means for transferring an image from the photosensitive member to the sheet;

stripping means provided downstream of the transferring means in the transport direction of the sheet for stripping the sheet from the photosensitive member;

transporting means for transporting the stripped sheet to fixing means;

a duct having an opening portion on the stripping means side thereof;

one or more fans provided in the other opening portion of the duct to suck a side opposite to a side of the sheet on which the image is formed; and operation signal detecting means for detecting electrical signals by a user's predetermined operation in preparation for the start of a copy job, and when the operation signal detecting means detects at least one of the electrical signals by the predetermined operation, at least one of the fans is started in synchronism with the detection signal thereof.

Also, an image forming apparatus according to the present invention comprises:

sheet supplying means for supplying a sheet to a photosensitive member;

transferring means for transferring an image from the photosensitive member to the sheet;

stripping means provided downstream of the transferring means in the transport direction of the sheet for stripping the sheet from the photosensitive member;

transporting means for transporting the stripped sheet to fixing means;

a duct having an opening portion on the transporting means side thereof;

one or more fans provided in the other opening portion of the duct to suck a side opposite to a side of the sheet on which the image is formed; and operation signal detecting means for detecting electrical signals by a user's predetermined operation in preparation for the start of a copy job, and when the operation signal detecting means detects at least one of the electrical signals by the predetermined operation, at least one of the fans is started in synchronism with the detection signal thereof.

It is preferable that after the termination of the operation of the image forming apparatus, at least one of the fans be stopped after it is operated for a predetermined time while maintaining a predetermined rotating speed.

It is preferable that when the operation signal detecting means detects at least one of the electrical signals by the predetermined operation, at least one of the fans be started in synchronism with the detection signal thereof, and when the image forming apparatus does not detect an image forming signal for a predetermined time, the fans be stopped.

The image forming apparatus has environment detecting means for detecting environment, and it is preferable that when the operation signal detecting means detects at least one of the electrical signals by the predetermined operation and the environment detecting means detects that the apparatus is in predetermined environment, the fans maintain their stopped state, and the fans be started in synchronism with the signal of the user's copy job starting operation.

The image forming apparatus has environment detecting means for detecting environment, and it is preferable that the rotating speed of the fans be fluctuated in conformity with the environment detected by the environment detecting means.

Also, an image forming apparatus according to the present invention comprises:

sheet supplying means for supplying a sheet to a photosensitive member;

transferring means for transferring an image from the photosensitive member to the sheet;

stripping means provided downstream of the transferring means in the transport direction of the sheet for stripping the sheet from the photosensitive member;

transporting means for transporting the stripped sheet to fixing means;

a duct having an opening portion on the stripping means side thereof;

one or more fans provided in the other opening portion of the duct to suck a side opposite to a side of the sheet on which the image is formed; and environment detecting means for detecting environment, and when the environment detecting means detects that the apparatus is in a predetermined environment, the rotation of the fans is stopped or the rotating speed of the fans is fluctuated.

Also, an image forming apparatus according to the present invention comprises:

sheet supplying means for supplying a sheet to a photosensitive member;

transferring means for transferring an image from the photosensitive member to the sheet;

stripping means provided downstream of the transferring means in the transport direction of the sheet for stripping the sheet from the photosensitive member;

transporting means for transporting the stripped sheet to fixing means;

a duct having an opening portion on the stripping means side thereof;

one or more fans provided in the other opening portion of the duct to suck a side opposite to a side of the sheet on which the image is formed; and type detecting means for detecting the type of the sheet, and when the type detecting means detects that the sheet is a predetermined type of paper, the rotation of the fans is stopped or the rotating speed of the fans is fluctuated in conformity with the type of paper.

As described above, the fans rise while the user is performing a predetermined operation in preparation for a copy job and therefore, it becomes possible to shorten the time from after the start of the copy job until the first sheet is delivered out of the image forming apparatus, and high productivity can be secured.

Further, the fans are stopped in the standby state of the image forming apparatus and therefore, it becomes possible to suppress the consumption of extra electric power, and by changing the rotating speed of the fans to a necessary rotating speed in conformity with the installation environment of the image forming apparatus or the type of the sheet, it becomes possible to suppress the consumption of extra electric power, and the purpose of the consideration for environmental problems can be achieved.

As described above, the present invention starts the fans when the electrical signal by the predetermined operation before the start of the copy job, to thereby shorten the time from after the start of the copy job until the first sheet is delivered out of the apparatus, whereby high productivity is made possible and it becomes possible to suppress the consumption of extra electric power in the standby state of the image forming apparatus.

DESCRIPTION OF THE PREFERRED EMBODIMENT

An image forming apparatus according to a preferred embodiment of the present invention will hereinafter be described in detail by way of example with reference to FIGS. 1 to 4. However, the dimensions, materials, shapes, relative dispositions, etc. of constituent parts described in the embodiment are not intended to restrict the scope of the invention thereto unless otherwise specified.

Figure 1:
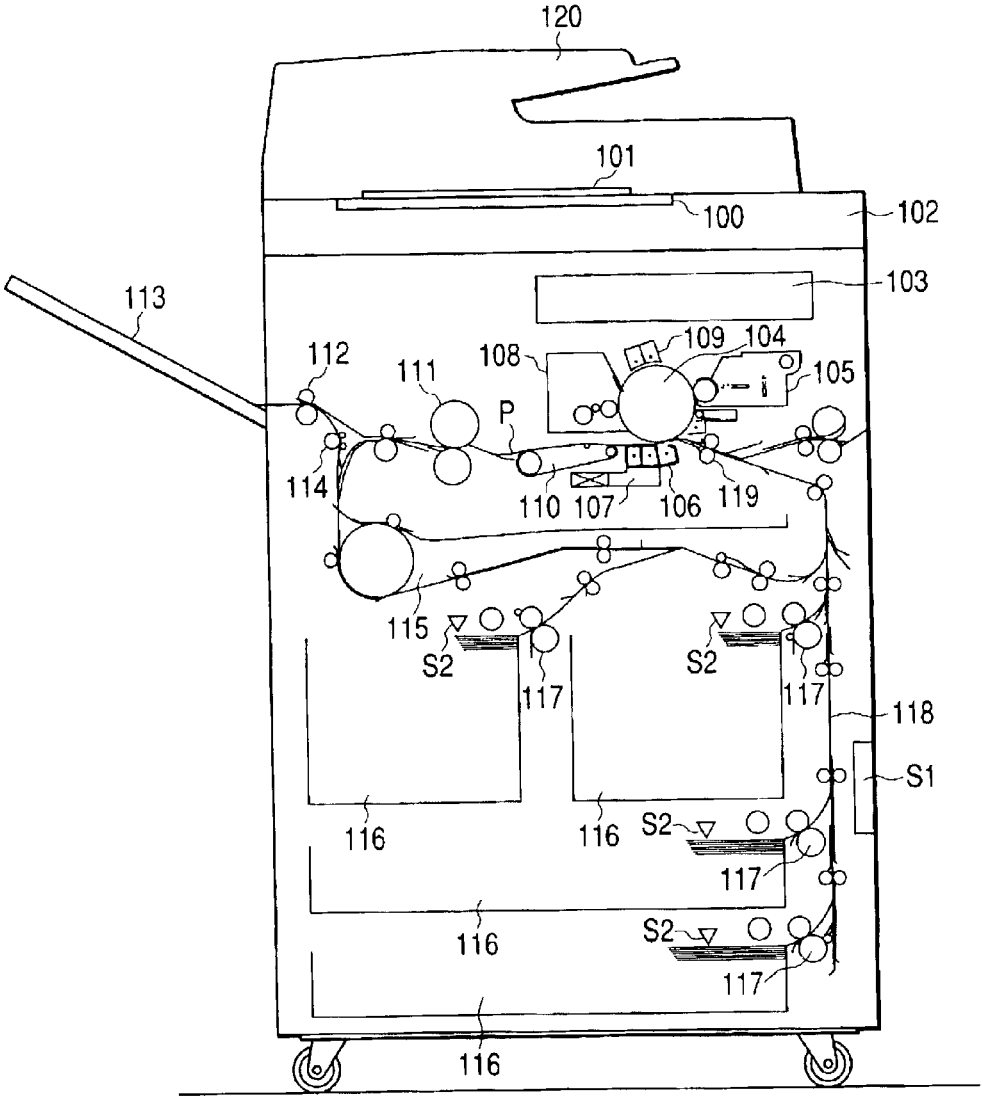
FIG. 1 is a cross-sectional view typically showing an image forming apparatus according to an embodiment of the present invention.
Figure 2:
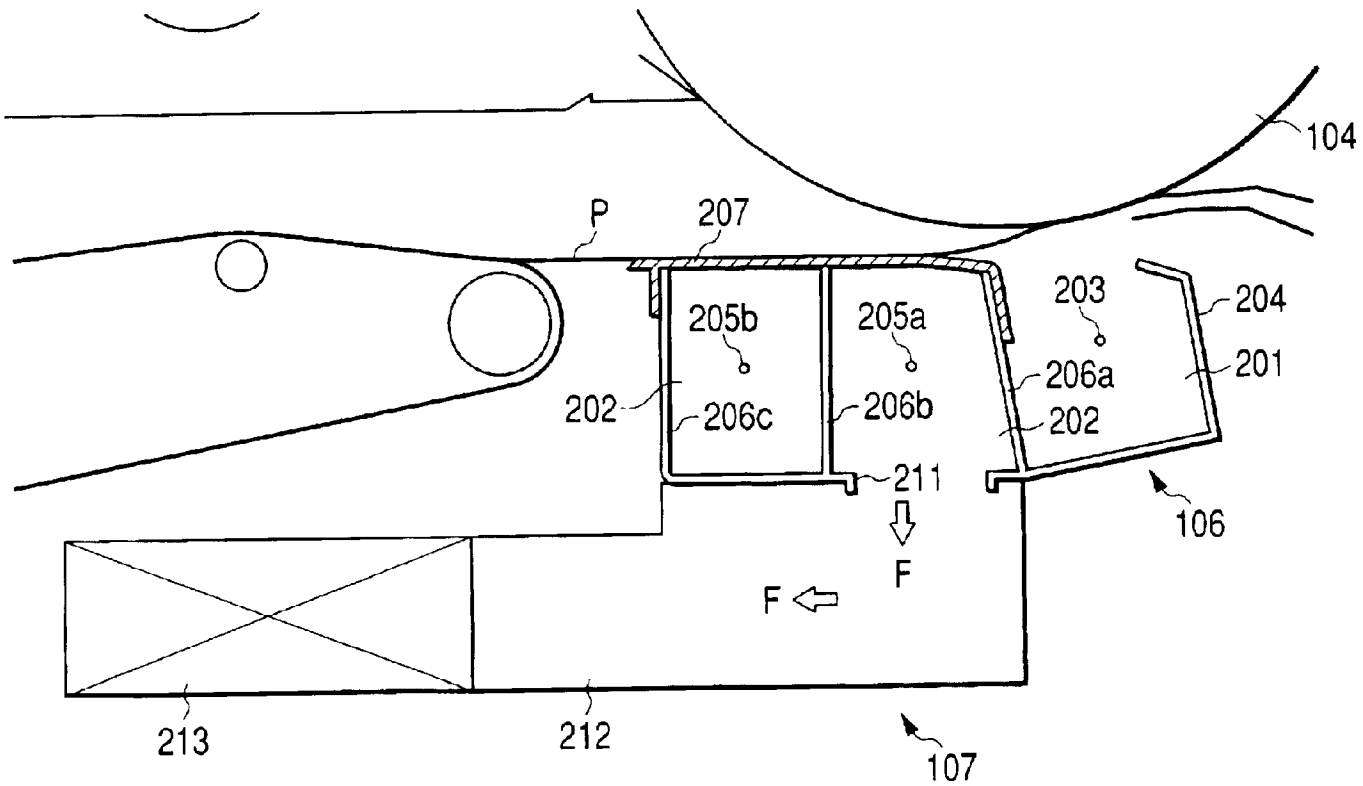
FIG. 2 is a cross-sectional view typically showing the surroundings of the stripping device and transferring device of the image forming apparatus according to the embodiment of the present invention.
Figure 3:
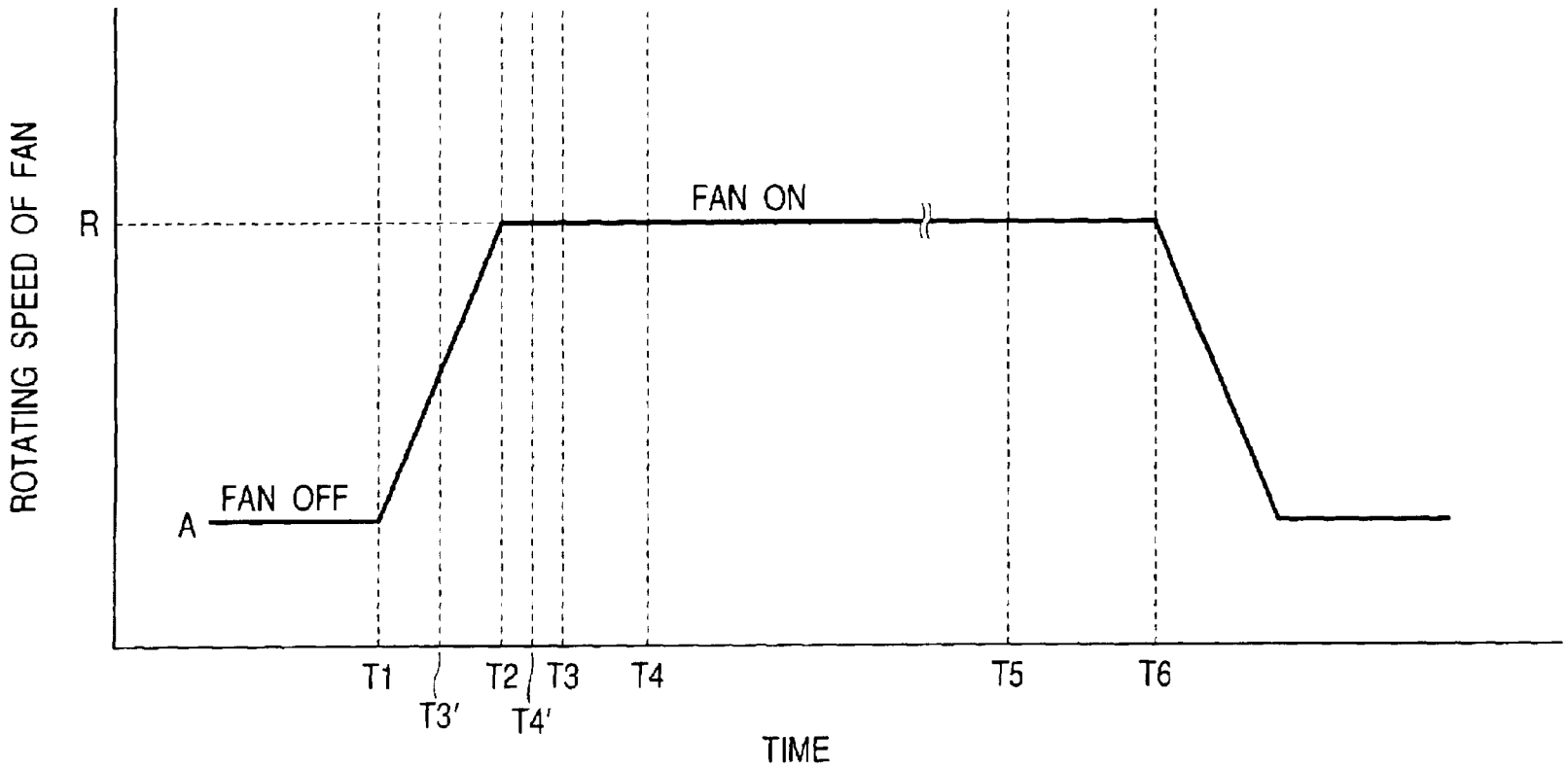
FIG. 3 shows the operation sequence of a fan according to the embodiment of the present invention.
Figure 4:
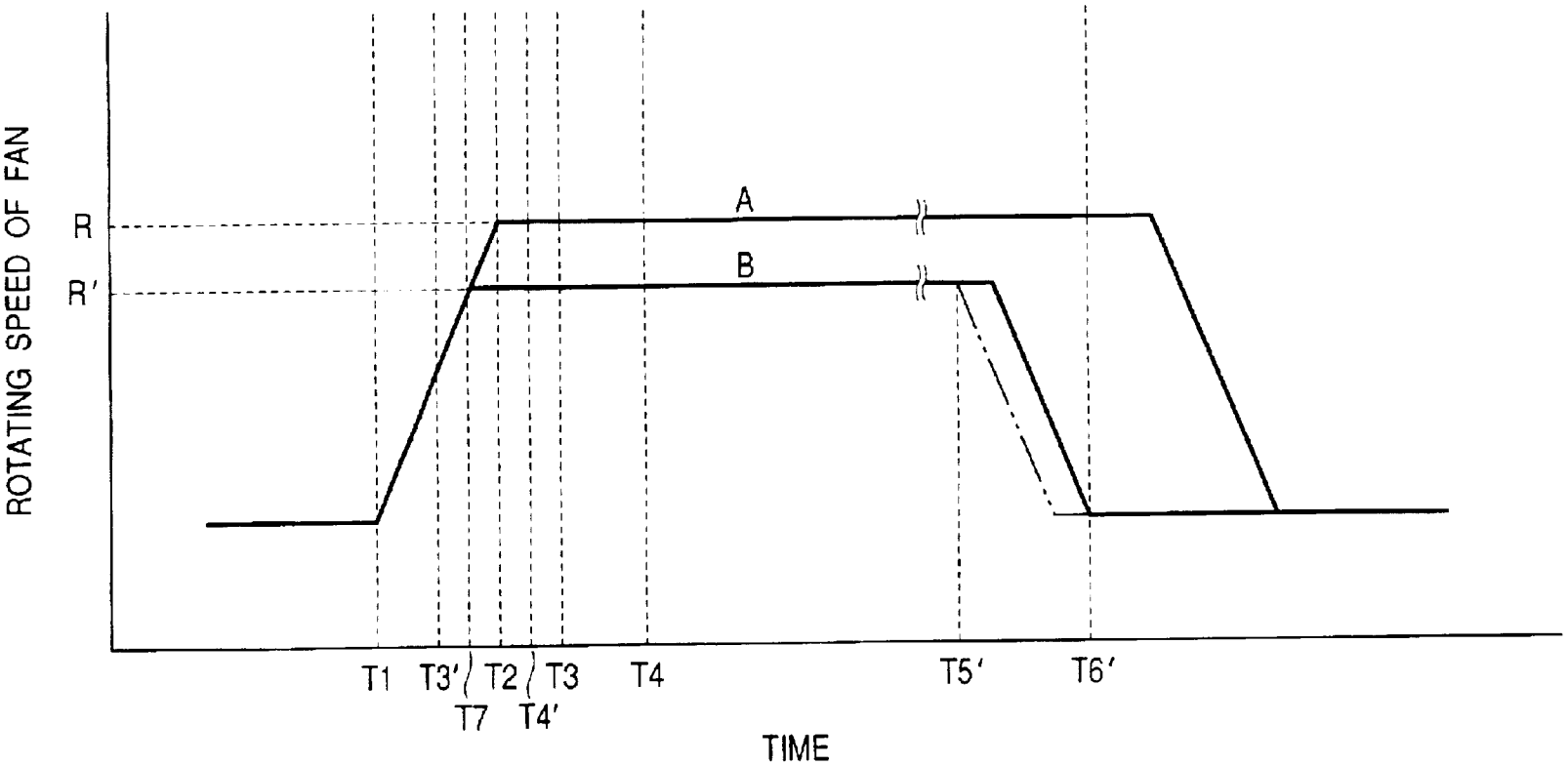
FIG. 4 shows the operation sequence of the fan according to the embodiment of the present invention.

FIG. 1 is a typical cross-sectional view of the image forming apparatus according to the embodiment of the present invention, FIG. 2 is an enlarged typical cross-sectional view showing the surroundings of the stripping means and transferring means of the image forming apparatus shown in FIG. 1, FIG. 3 simply shows the relation between the time of the standby state through the copying operation till the stop of the copying operation of the image forming apparatus and the operation sequence of a stripping fan, and FIG. 4 simply shows the relation between the time of the standby state through the copying operation till the stop of the copying operation when the image forming apparatus is installed in predetermined environment and the operation sequence of the stripping fan.

In the present embodiment, the operation sequence of the stripping fan provided in stripping means through a duct will be described in detail, but the operation sequence of a fan provided in transporting means through a duct is substantially similar thereto and therefore need not be described.

In FIG. 1, the reference numeral 100 designates an original glass stand on which an original 101 is placed, and the reference numeral 102 denotes a reader unit for reading the image information of the original 101. The reference numeral 103 designates an optical unit for applying light having the image information of the original 101 or other image information.

The optical unit 103 is provided with a laser beam source turned on and off by an electrical signal controlled by processing the image information obtained by the reader unit 102 or other image information through an image processing device (not shown) and on an optical path for directing a laser beam from the laser beam source to a photosensitive drum 104, there are provided a plurality of optical parts, namely, a plurality of mirrors for reflecting the laser beam, and a plurality of optical members (such as various lenses) for optically effecting enlargement and correction.

Also, around the photosensitive drum 104, there are disposed a developing device 105 for supplying a toner to the photosensitive drum 104 to visualize an electrostatic latent image on the photosensitive drum, a transfer and strip charging device 106 for transferring the toner image to a sheet P, and stripping the sheet P electrostatically attracted to the photosensitive drum 104, a strip suction device 107 for sucking the sheet to assist in the stripping by the transfer and strip charging device 106, cleaning means 108 for removing any toner remaining on the photosensitive drum 104 without being transferred to the sheet P, and pre-exposure means 109 for erasing a residual latent image on the photosensitive drum 104.

There is also disposed transporting means 110 for transporting the sheet P having the toner image transferred thereto from the photosensitive drum 104 to fixing means 111.

There is also provided a delivery sheet inverting device 114 for controlling whether to deliver the sheet P having left the fixing means 111 to a delivery tray 113 outside the apparatus by delivery rollers 112 or to transport the sheet P to a re-feed device 115 for re-feeding the sheet P to the photosensitive drum 104 when two-side or multiple copy is to be taken. There is further provided a feed cassette 116 for stacking and stocking sheets P thereon.

The operation of the image forming apparatus of the above-described construction will now be sequentially described.

First, when a user depresses a copy start button (not shown), the sheets P stacked on the feed cassette 116 are transported one by one from the feed cassette 116 to a vertical path transporting portion 118 by a feed device 117, and are sent to registration rollers 119 which are sheet supplying means.

Next, scanning is started by the reader unit 102 to convert the image information of the original 101 into an electrical signal, and light having the image information of the original is applied to the surface of the photosensitive drum 104 by the optical unit 103 through an image processing device (not shown) and the image is recorded. It is also possible to perform this operation on the basis of image information inputted from an external device.

Also, the registration rollers 119 start the transport of the sheet P so as to be synchronized with this operation.

At this time, the electrostatic latent image which is the image information of the original 101 recorded on the photosensitive drum 104 is made into a toner image by the developing device 105, and the toner image is transferred to the sheet P which is a transfer material by the transfer and strip charging device 106, whereafter the sheet P is stripped from the photosensitive drum 104 by the transfer and strip charging device 106 and the suction device 107. The thus stripped sheet P is transported to the fixing device 111 which is fixing means by the transporting device 110 which is transporting means, and the toner image is fixed on the sheet P by the fixing device 111, whereafter in the case of one-side copy, the sheet P is transported to the delivery rollers 112 by the delivery sheet inverting device 114 and is delivered onto the delivery tray 113 outside the apparatus.

Also, in the case of two-side copy or multiple copy, the sheet P on which the toner image has been fixed by the fixing device 111 is again transported to the photosensitive drum 104 by the re-feed device 115 with the aid of the delivery sheet inverting device 114, and a toner image is again transferred to the sheet P, which is thereafter delivered onto the delivery tray 113 outside the apparatus via the transport device 110, the fixing device 111, the delivery sheet inverting device 114 and the delivery rollers 112 in the named order.

Next, regarding the transfer and strip charging device 106 and the devices disposed around it, the details of a typical cross section are shown in FIG. 2.

The transfer and strip charging device 106 is comprised of transferring means 201 and stripping means 202. A wire 203 for a transfer charger and a shield plate 204 for determining the discharging area of the transfer charger are provided in the transferring means 201.

Wires 205*a* and 205*b* for a strip charger and shield plates 206*a*, 206*b* and 206*c* for determining the electricity discharging area of the strip charger are provided in the stripping means 202.

A guide member 207 molded by a mold is provided on the sheet-passing surfaces of the transferring means 201 and the stripping means 202, and extends from the shield plate 206*c* to the downstream side with respect to the sheet passing direction. Also, the guide member 207 prevents the sheet P from being caught by the constituent parts of the transferring means 201 and the stripping means 202.

The suction device 107 is constructed as follows. Stripping the sheet P from the photosensitive drum 104 is assisted by a construction in which there is an opening portion 211 on the lower side of the stripping means 202 and a stripping fan 213 is provided in the other opening portion of a duct 212 also having an opening portion so that a suction force may act in the direction indicated by the arrow F through the duct 212.

FIGS. 3 and 4 simply show the relation between the time from the standby state through the copying operation till the termination of the copying operation of the image forming apparatus and the operation sequence of the stripping fan 213.

As shown in FIG. 3, in a line designated by "A" in the graph, up to a time T1 represents the standby state of the image forming apparatus. When at the time T1, the user performs predetermined operations in preparation for the starting of a copy job, such as the opening and closing of the feed cassette 116, the setting of an original onto an auto original feeder 120, the opening and closing of the auto original feeder 120 and the operation of a copy job operating button (not shown), the detection signal of a sensor (not shown) for electrically detecting each operation becomes a trigger and the stripping fan 213 is started, and reaches a predetermined use rotating speed by a time T2.

When here, the user depresses the copy start button at T3 (T2<T3), the stripping fan 213 has already risen to the use rotating speed at T2 and therefore, the leading edge of the sheet P arrives at the position of the registration rollers 119 at T4and thus, shift can be made to the image forming operation without the sheet P standing by at the registration rollers 119.

Also, when the user depresses the copy start button (not shown) at T3' before the rotating speed of the stripping fan 213 rises to R (time=T2), considering the total $\Delta T$ of the time required for the user's copy preparing operations, the original reading and image processing time and the time for feeding the sheet P to the registration rollers 119, the relation that $\Delta T>(T2-T1)$ can be fully satisfied and therefore, the time when the leading edge of the sheet P arrives at the registration rollers 119 is T4', and shift can be made to the image forming operation without the sheet P standing by at the registration rollers 119.

On the other hand, even when the electrical signal by the above-described predetermined operations is detected and the fan is started, if an image forming signal is not detected for a predetermined time thereafter, that is, if the copy job by the user is not effected, it means the consumption of extra electric power to keep the fan started and therefore, the fan is stopped.

Also, the stripping fan 213 continues to be still operated at a predetermined rotating speed till T6 a predetermined time after the termination of the copy job so that the stripping fan 213 can work at the use rotating speed even if the next job is effected after at T5, the image forming operation is terminated and the last sheet P is delivered out of the image forming apparatus. The rotating speed in this case need not always be the rotating speed during the image forming operation, but may suitably be decreased with the size and rising time of the fan, the transport speed of the image forming apparatus, etc. taken into account. Also, the above-mentioned predetermined time after the termination of the copy job may suitably be changed with the frequency of use of the image forming apparatus taken into account.

If thereafter, at T5 to T6, instructions for the next copy job do not come in, the stripping fan 213 is stopped at T6. Thus, it is possible to suppress the consumption of extra electric power.

Next, in the image forming apparatus started by the fan sequence shown in FIG. 3, the lower in temperature and humidity becomes the installation environment thereof, the greater becomes the rigidity of the sheet P and the more improved is the separability thereof from the drum 104 and therefore, if the rotating speed of the stripping fan 213 remains R, excessive specification will be brought about.

Consequently, if the image forming apparatus is installed in predetermined environment in which the separability of the sheet P becomes better, when the environment is detected by the installation environment detecting sensor S1 of FIG. 1, control is effected so as to lower the rotating speed R of the stripping fan 213 indicated by the line "A" shown in the graph of FIG. 3 to the necessary rotating speed R' indicated by the line "B" shown in the graph of FIG. 4, or stop the stripping fan 213. Accordingly, consumed electric power can be saved.

Here, the installation environment to be detected by the installation environment detecting sensor S1 may be the interior of a room in which the main body of the image forming apparatus is installed, but may also be, for example, the atmosphere in the image forming apparatus. Particularly, by providing the sensor near the cassette on which the sheets P are stacked or the stripping fan, it is possible to accurately foresee the state of the sheets P and decrease the unnecessary operation of the fan and therefore consumed electric power can be saved.

Also, thick paper or the like which is great in rigidity can in some cases be stripped from the drum 104 without the rotating speed of the stripping fan 213 being lowered or the stripping fan being rotated, and if the rotating speed of the stripping fan 213 remains R even for such type of paper, excessive specification will be brought about as in the above-described case.

Consequently, if the sheet P being transported is a type of paper good in separability, for example, great in rigidity, when it is detected by the paper type detecting sensor S2 of FIG. 1, control is effected so as to lower the rotating speed R of the stripping fan 213 indicated by the line "A" in the graph of FIG. 3 to the necessary rotating speed R' indicated by the line "B" in the graph of FIG. 4, or stop the stripping fan 213. As the paper type detecting sensor, use can suitably be made of one which detects the type of paper from the transmitted light or the reflected light of light emitted from a sensor, or one which detects the thickness of paper. Accordingly, consumed electric power can be saved.

Further, when the time required for the stripping fan 213 to rise to the rotating speed R' which is indicated in FIG. 4 is defined as T7 and the original reading and image processing time and the time required to feed the sheet P to the registration rollers 119 are defined as $\Delta T'$, when $\Delta T'>(T7-T1)$, the stripping fan 213 need not be rotated from before the start of the copy job, but can be started in synchronism with the start of the copy job and therefore, control is effected so as not to start the stripping fan 213 even when the electrical signal by the above-described predetermined operations is detected. Also, since the stripping fan 213 can be started in synchronism with the start of the copy job, it is not necessary for the stripping fan 213 to continue to be operated at a predetermined rotating speed for a predetermined time for the next copy job after the termination of the preceding copy job and therefore, after the image forming operation is terminated at T5', the stripping fan is rotated at R' for a predetermined time, when after the stripping fan 213 is stopped at T6'.

As indicated by double-dotted line, immediately after the image forming operation is terminated at T5', the stripping fan 213 may be stopped at T6'.

Figure 5:
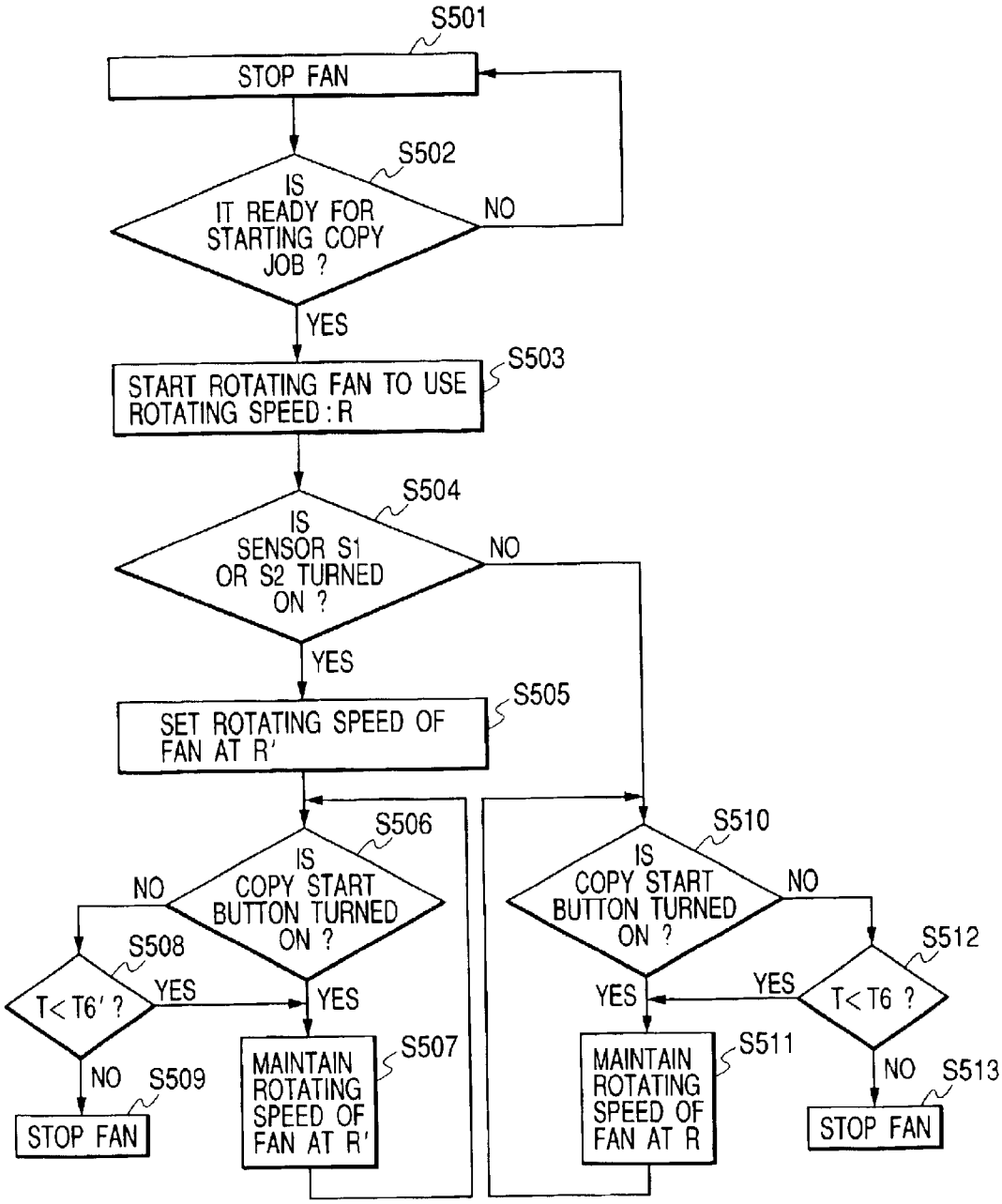
FIG. 5 is a flowchart illustrating the operation procedure of the fan of the image forming apparatus according to the embodiment of the present invention.
Figure 6:
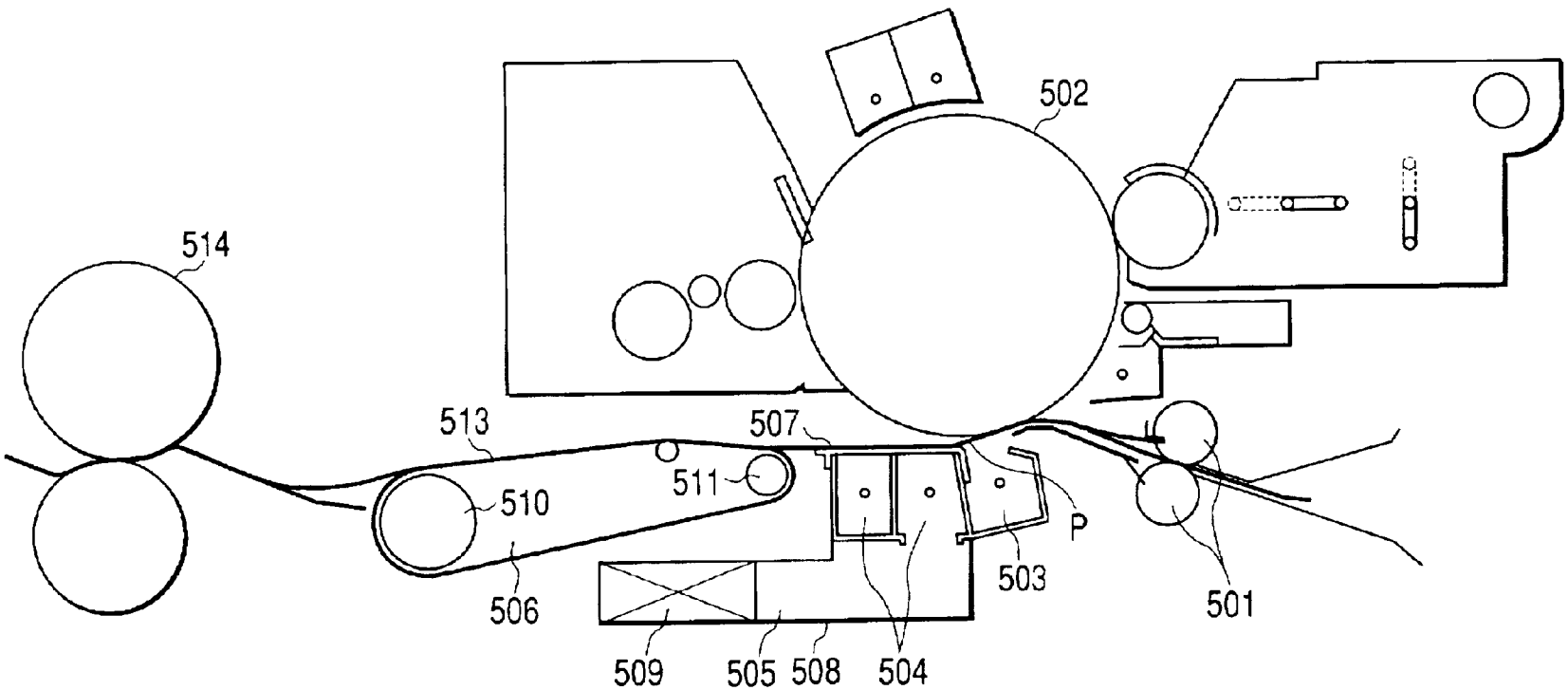
FIG. 6 PRIOR ART
FIG. 6 is a cross-sectional view typically showing an image forming portion according to the prior art.
Figure 7:
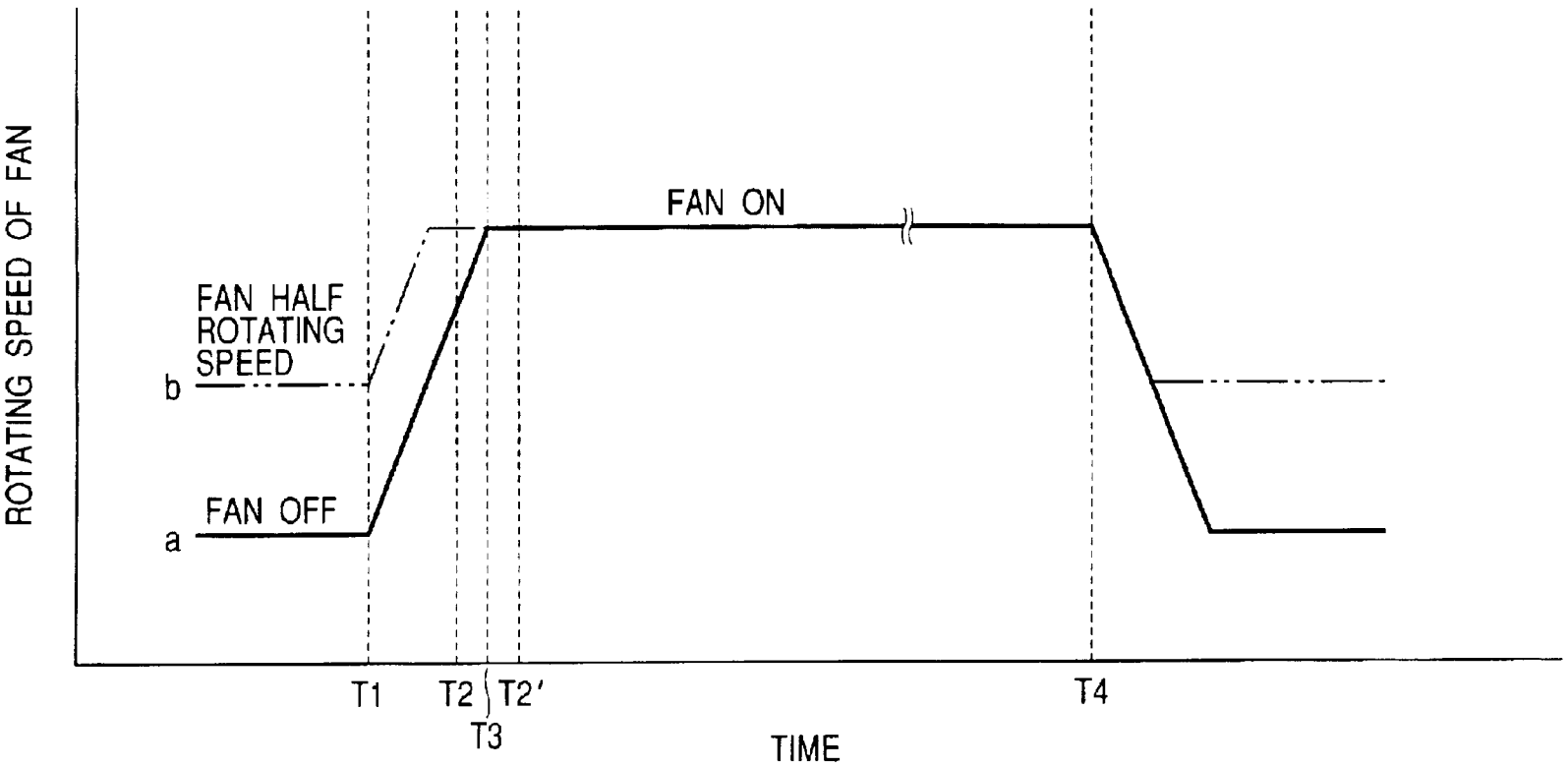
FIG. 7 PRIOR ART
FIG. 7 shows the operation sequence of a fan in an image forming apparatus according to the prior art.

On the basis of the foregoing description of the operation, description will hereinafter be made more specifically with reference to a flowchart. FIG. 5 is a flowchart illustrating the operation procedure of the fan of the image forming apparatus according to the present embodiment.

Usually in the standby state, the stripping fan 213 is stopped (S501).

When in this state, a predetermined operation in preparation for the start of the copy job is electrically detected by a sensor (not shown), the stripping fan is started (S502), and the use rotating speed R is reached by the time T2 (S503).

Next, when the installation environment detecting sensor S1 detects that the image forming apparatus is installed in predetermined environment in which the separability of the sheet P becomes better, or when the paper type detecting sensor S2 detects that the sheet P being transported is a type of paper good in separability, for example, great in rigidity (S504), the rotating speed of the stripping fan is made equal to a rotating speed R' indicated by the line "B" in the graph of FIG. 4 (S505).

When in this state, it is detected that the copy start button has been depressed (S506), the rotating speed of the stripping fan 213 is maintained at R' (S507), and when the copy start button is not depressed, whether a time T has further elapsed from the stop time T6' is judged (S508). When T<T6', the stripping fan continues to be rotated at the rotating speed R' for a predetermined period for the next copy job. On the other hand, when T>T6', the stripping fan 213 is stopped to suppress the useless electric power consumption by the unnecessary rotation of the stripping fan 213 (S509).

Also, when the installation environment detecting sensor S1 detects that the image forming apparatus is not installed in the predetermined environment in which the separability of the sheet P becomes better, or when the paper type detecting sensor S2 does not detect that the sheet P being transported is a type of paper good in separability, for example, great in rigidity (S504), the rotating speed of the stripping fan 213 maintains the rotating speed R indicated by the line "A" in the graph of FIG. 3.

When in this state, it is detected that the copy start button has been depressed (S510), the rotating speed of the stripping fan 213 is maintained at R (S511), and when the copy start button is not depressed, whether the time T has further elapsed from the stop time T6 is judged (S512). When T<T6, the stripping fan continues to be rotated at the rotating speed R for a predetermined period for the next copy job. On the other hand, when T>T6, the stripping fan 213 is stopped to suppress the useless electric power consumption by the unnecessary rotation of the stripping fan 213 (S513).

By using the above-described sequence, shift can be smoothly made to the image forming operation without the first sheet P being made to stand by at the registration rollers 119 after the start of copying and therefore, improved productivity in a high-speed machine can be realized.

Also, both after the termination of the copying operation of the image forming apparatus and during the next copying operation of the apparatus, any loss time required for the rising of the stripping fan 213 can be eliminated and therefore, further improved productivity can be realized.

Further, in the standby state of the image forming apparatus, the stripping fan 213 can be kept stopped, and the rotating speed of the stripping fan 213 is suitably variably controlled in conformity with the installation environment of the image forming apparatus or the type of the sheet to be transported, whereby consideration for the environment can be given without extra electric power being consumed.

What is claimed is:

1. An image forming apparatus comprising:

sheet supplying means for supplying a sheet to a photosensitive member;

transferring means for transferring an image from said photosensitive member to the sheet;

stripping means provided downstream of said transferring means in a transport direction of the sheet for stripping the sheet from said photosensitive member;

transporting means for transporting the stripped sheet to fixing means;

a duct having an opening portion on a side of said stripping means thereof;

one or more fans provided in another opening portion of said duct to apply suction to a side opposite to a side of the sheet on which the image is formed; and operation signal detecting means for detecting electrical signals by a user's predetermined operation in preparation for a start of a copy job, wherein when said operation signal detecting means detects at least one of electrical signals by said predetermined operation, at least one of said fans is started in synchronism with the detected electrical signal.

2. An image forming apparatus comprising:

sheet supplying means for supplying a sheet to a photosensitive member;

transferring means for transferring an image from said photosensitive member to the sheet;

stripping means provided downstream of said transferring means in a transport direction of the sheet for stripping the sheet from said photosensitive member;

transporting means for transporting the stripped sheet to fixing means;

a duct having an opening portion on a side of said transporting means thereof;

one or more fans provided in another opening portion of said duct to apply suction to a side opposite to a side of the sheet on which the image is formed; and operation signal detecting means for detecting electrical signals by a user's predetermined operation in preparation for a start of a copy job, wherein when said operation signal detecting means detects at least one of the electrical signals by said predetermined operation, at least one of said fans is started in synchronism with the detected electrical signal.

3. An image forming apparatus according to claim 1 or 2, wherein after a termination of the copy job, at least one of said fans is stopped one of said fans is stopped after it has been operated for a predetermined time while maintaining a predetermined rotating speed.

4. An image forming apparatus according to claim 1 or 2, wherein when said operation signal detecting means detects at least one of the electrical signals by said predetermined operation, at least one of said fans is started in synchronism with the detected electrical signal, and when said image forming apparatus does not detect an image forming signal for a predetermined time, said fan is stopped.

5. An image forming apparatus according to claim 1 or 2, further comprising environment detecting means for detecting environment, wherein when said operation signal detecting means detects at least one of the electrical signals by said predetermined operation and said environment detecting means detects that the apparatus is in predetermined environment, said fans maintain their stopped state, and said fans are started in synchronism with a signal of a user's copy job starting operation.

6. An image forming apparatus according to claim 1 or 2, further comprising environment detecting means for detecting environment, wherein a rotating speed of said fans varies in accordance with the environment detected by said environment detecting means.

7. An image forming apparatus according to claim 1 or 2, further comprising:

transporting means for transporting the stripped sheet to fixing means;

environment detecting means for detecting environment, wherein when said environment detecting means detects that the apparatus is in predetermined environment, rotation of said fans is stopped or a rotating speed of said fans is varied in accordance with the environment.

8. An image forming apparatus according to claim 1 or 2, further comprising:

type detecting means for detecting a type of the sheet, wherein when said type detecting means detects that the sheet is a predetermined type of paper, rotation of said fans is stopped or a rotating speed of said fans is varied in accordance with the type of paper.

* * * * *

UNITED STATES PATENT AND TRADEMARK OFFICE

CERTIFICATE OF CORRECTION

PATENT NO. : 6,801,726 B2
APPLICATION NO. : 10/199106
DATED : October 5, 2004
INVENTOR(S) : Akihiro Shimizu et al.

It is certified that error appears in the above-identified patent and that said Letters Patent is hereby corrected as shown below:

COLUMN 1:
Line 24, "into" should be deleted.

COLUMN 2:
Line 29, "have" should read --has--.

COLUMN 5:
Line 24, "before" should read --is detected before--.

COLUMN 9:
Line 51, "time, when after" should read --time, and then--.

COLUMN 11:
Line 40, "one of said fans is stopped" should be deleted.

Signed and Sealed this

Sixteenth Day of October, 2007

JON W. DUDAS
*Director of the United States Patent and Trademark Office*